US007824511B1

(12) United States Patent
Baker et al.

(10) Patent No.: US 7,824,511 B1
(45) Date of Patent: Nov. 2, 2010

(54) METHOD OF MAKING GAP PROPELLANTS BY PRE-REACTING A METAL FUEL WITH ISOCYANATE BEFORE MIXING WITH BINDER AND PLASTICIZER

(75) Inventors: James J. Baker, Waldorf, MD (US); Tina Woodland, Byran's Road, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 790 days.

(21) Appl. No.: 11/879,523

(22) Filed: Jul. 3, 2007

(51) Int. Cl.
*C06B 45/10* (2006.01)
*C06B 21/00* (2006.01)
*D03D 23/00* (2006.01)

(52) U.S. Cl. ..... 149/19.92; 149/109.6; 264/3.1

(58) Field of Classification Search ..... 149/19.92, 149/109.6; 264/3.1
See application file for complete search history.

(56) References Cited

U.S. PATENT DOCUMENTS 3,745,075 A * 7/1973 Muenker et al. ..... 149/19.4
3,791,892 A * 2/1974 Hammond et al. ..... 149/19.4
4,050,968 A * 9/1977 Goldhagen et al. ..... 149/19.4
4,268,450 A 5/1981 Frankel et al.
4,379,903 A 4/1983 Reed, Jr. et al.
4,891,438 A 1/1990 Ahad
5,124,463 A 6/1992 Ampleman
5,223,056 A 6/1993 Ahad
5,472,532 A * 12/1995 Wallace, II ..... 149/19.4

* cited by examiner

*Primary Examiner*—Aileen Felton
(74) *Attorney, Agent, or Firm*—Fredric J. Zimmerman

(57) ABSTRACT

A method for making high energy compositions, such as propellants, explosives, pyrotechnics or the like, including a solid metal particulate fuel dispersed in a cured binder matrix. The compositions are formed with ingredients including a particulate metal fuel such as boron, binder polymer (such as GAP polyol), binder plasticizer, and a curing agent containing isocyanate. The improved method includes pre-reacting the particulate metal fuel with an amount of isocyanate, which acts as a curative to neutralize residual acid. The particulate metal fuel/isocyanate from the pre-curing step is mixed together with the binder polymer, binder plasticizer, and remaining curing agent to form the solid propellant. The initial neutralization of the metal fuel avoids gassing and improves the mechanical properties of the propellant yield.

20 Claims, No Drawings

METHOD OF MAKING GAP PROPELLANTS BY PRE-REACTING A METAL FUEL WITH ISOCYANATE BEFORE MIXING WITH BINDER AND PLASTICIZER

STATEMENT OF GOVERNMENT INTEREST

The invention described herein may be manufactured and used by or for the Government of the United States of America for governmental purposes without the payment of any royalties thereon or therefore.

FIELD OF THE INVENTION

The present invention relates to a method of making propellants and, more particularly, to a method of making Glycidyl Azide Polymer (GAP) propellants with particulate metal fuels, and particularly boron, by pre-reacting the metal fuel with excess isocyanate before mixing the GAP polymer, plasticizer, and boron to produce a finished product that is not spongy.

BACKGROUND OF THE INVENTION

Solid high energy compositions, such as propellants, explosives, pyrotechnics or the like, typically include solid particulates, such as fuel particles and oxidizer particles, dispersed and immobilized in a cured binder matrix.

Typical oxidizers include commonly used oxidizers for propellant compositions, such as ammonium nitrate (AN), ammonium perchlorate (AP), hydroxylammonium nitrate (HAN), alkali metal perchlorates, alkali metal nitrates, or mixtures thereof.

Typical reactive metal fuels include those commonly used in propellant compositions such as Boron (B) or other metals such as Al, Mg, Zn, W, Zr, Ti, or mixtures thereof.

One type of elastomer binder which has considerable promise is based upon glycidyl azide polymer (GAP). GAP is a hydroxyl-terminated polyether polymer. GAP can be cured, as is conventional, with polyfunctional isocyanates to form elastomers. GAP-based elastomers used as propellant binders provide a definite energy advantage relative to polycaprolactone (PCP)-based elastomers, and polyethylene glycol (PEG)-based elastomers, and polybutadiene polymers such as hydroxyl-terminated polybutadiene (HTPB).

Previous inventors have cured boron with a mixture of GAP polymer, plasticizer, a cure catalyst, and isocyanate. Current methods of making GAP propellants that incorporate solid reactive metal fuels, and particularly boron (B), typically involve mixing the boron with GAP polymer, plasticizer, and a cure catalyst first and then adding the isocyanate last. These existing methods possess a number of limitations. Reaction mixtures of GAP and isocyanates using known effective catalysts in the presence of some commonly used propellant ingredients have a tendency to gas such that the cured propellants produced are not useable. Specifically, severe gassing results when boron is first mixed with GAP polymer and plasticizer, and then the cure catalyst [DBTDL]-isocyanate [IPDI] mixture is later added. The DBTDL is a cure catalyst, and IPDI is a curative. Other cure catalysts can be used, such as TPB, triphenyl bismuth. It is also possible to cure the polymer without using the catalyst. However, most formulators use the catalyst to ensure that the polymer cures. DBTDL makes the mixtures cure very fast, while the others are slower to cure. However, when the cure catalyst [DBTDL]-isocyanate [IPDI] mixture is added, the gassing occurs because residual acidity on the boron particles reacts with the isocyanate. The gassing results in undesirable holes and voids within the mix, and the end product is voluminous, looks like a sponge, and is not usable. It would be greatly advantageous to avoid this gassing.

Efforts toward this end have been attempted. For example, U.S. Pat. No. 4,379,903 shows a propellant binder cure catalyst in which curing of GAP/isocyanate mixtures as binders is accomplished without gassing by employing a catalyst comprising a mixture of cure catalyst such as triphenyl bismuth (TPB) and small amounts of dibutyltin dilaurate (tin salt) within the cure system. However, boron was not used in these propellants.

It is also known that a "proton sponge" can be added to the mixture of boron, GAP polymer, plasticizer and a cure catalyst and then adding the isocyanate to this mixture. This well-known proton sponge [is 1,8-bis (dimethylamino) naphthalene] will eliminate the spongy result and severe gassing if it is added to the GAP polymer and plasticizer mixture, before this mixture is added to the cure catalyst [DBTDL]-isocyanate [IPDI]. However, the proton sponge is a rather expensive ingredient that could add unknown long-term effects to the propellant formulation.

The present inventors have unexpectedly found that it is possible to pre-react the curative with a metal to eliminate the gassing reaction when the cure catalyst [DBTDL]-isocyanate [IPDI] mixture is added. This process avoids the spongy product without using the costly proton sponge.

SUMMARY OF THE INVENTION

It is, therefore, a primary object of the present invention to provide a method of making propellants, without the occurrence of severe gassing or the consequent creation of a spongy mass, by pre-reacting curative with metal fuel particulates before mixing the GAP polymer, plasticizer, and boron to produce a finished product that is not spongy.

Yet another object of the present invention is to provide a method of making propellants that are economical to manufacture to provide for widespread, cost-effective use.

Still another object of the present invention is to provide a method of making propellants without using new ingredients or propagating unknown side effects.

These and other objects are accomplished by a method for making a propellant formulation including a solid metal particulate fuel dispersed in a cured binder matrix, from ingredients including a particulate metal fuel, binder polymer, binder plasticizer, and curing agent containing isocyanate. The method includes an initial step of pre-reacting the particulate metal fuel with an amount of isocyanate, to neutralize residual acid. The particulate metal fuel/isocyanate from the pre-curing step is mixed together with the binder polymer, binder plasticizer, and remaining curing agent to form a solid propellant. The initial neutralization of the metal fuel avoids gassing and improves the mechanical properties of the propellant yield. The present method and resulting formulation does not contain ingredients with unknown effects and it may be economically manufactured to provide for widespread, cost-effective use.

DETAILED DESCRIPTION OF EXEMPLARY EMBODIMENTS OF THE INVENTION

The present invention is a method of preparing propellant by pre-reacting curative with metal fuel particulates, prior to mixing with GAP polymer and plasticizer, to produce a finished product that is not spongy so that gassing is minimized. More specifically, the present method substantially reduces or eliminates gassing during the making of Glycidyl Azide Prepolymer (GAP) propellants that use boron metal fuel by pre-reacting the boron metal fuel with excess isocyanate to neutralize its acidity, and mixing GAP polymer, plasticizer, and the neutralized boron to eliminate gassing and produce a finished product, which is not spongy.

The present method forms a composite propellant. The propellant employs: 1) a binder system and, 2) a composite propellant composition in the binder system. The propellant in this case generally includes one or more oxidizers, and reactive metals, including boron dispersed throughout the binder.

In an exemplary embodiment, the present binder system combines a polymer GAP, such as, a GAP polyol, a GAP plasticizer, a curative and, optionally, a cure catalyst. In an exemplary embodiment, GAP polymers include linear or branched glycidyl azide polymers, such as, GAP polymers having hydroxy-terminal ends, known as diols or polyols. In an exemplary embodiment, GAP plasticizers include GAP polymers, which do not include hydroxy terminated ends. Examples of these GAP polymers are described in U.S. Pat. Nos. 4,268,450 (Frankel), 4,891,438 (Ahad), 5,124,463 (Ampleman), and 5,223,056 (Ampleman). The present invention also contemplates the use on non-GAP polymers such as HTPB polymer. The curative is an isocyanate curing agent, such as, hexamethylene diisocyanate (HMDI), isophorone diisocyanate (IPDI), toluene diisocyanate (TDI), trimethylxylene diisocyanate (TMDI), dimeryl diisocyanate (DDI), diphenylmethane diisocyanate (MDI), naphthalene diisocyanate (NDI), dianisidine diisocyanate (DADI), phenylene diisocyanate (PDI), xylene diisocyanate (MXDI), other diisocyanates, triisocyanates, other polyfunctional isocyanates or mixtures thereof. The isocyanate curing agent may be used alone, or in combination with other known curing catalysts such as dibutyl tin dilaurate [DBTDL].

In addition to the propellant binder system, the composite propellant compositions include one or more oxidizers and reactive metals dispersed throughout the binder. Generally, oxidizers include commonly used oxidizers for propellant compositions, such as ammonium nitrate (AN), ammonium perchlorate (AP), hydroxylammonium nitrate (HAN), alkali metal perchlorates, alkali metal nitrates, or mixtures thereof. The reactive metal fuel is particulate boron, alone or in combination with other metal fuel particulates. Other metals, such as aluminum powder, do not seem to react with the isocyanate and, thus, are not a problem. Boron, on the other hand, does react with the isocyanate and hence causes problems. Thus, the present invention is particularly suited for propellant compositions incorporating boron.

By way of contrast, in the traditional preparation method, all the foregoing ingredients except for the isocyanate curing agent are added and mixed. As the last step, the isocyanate is added. As previously stated, residual acidity on the boron particles interferes with the reaction of isocyanate with the GAP polymer. The gassing results in undesirable holes and voids within the mix.

To avoid the gassing, the present method adds an initial pre-curing step. An amount of isocyanate (in an exemplary embodiment, the same GAP curing agent) is added to the metal, boron, and is allowed to react. This step may be done before all of the foregoing ingredients are mixed. After this initial reaction, the polymer, GAP plasticizer, and cure catalyst may be added and mixed in with the pre-cure mixture of isocyanate and boron (SB-90). While an exemplary embodiment is described in the context of a GAP polymer, and specifically GAP polyol, one skilled in the art will readily understand that an HTPB polymer or any other polymer may be used.

Example 1

Actual

A propellant composition was prepared by combining the following ingredients, with relative weight percentages shown.

| | |
|---|---|
| GAP polyol | 25.00 |
| GAP plasticizer | 30.00 |
| Boron (SB-90) | 40.00 |
| IPDI/DBML* | 5.00 |

The isocyanate curing agent here was a combination of isophorone diisocyanate (IPDI) as a curing agent, and dibutyl tin dilaurate (DBTDL) as a cure catalyst. The cure catalyst (DBTDL) was mixed into the IPDI prior to adding to the whole mixture. Again, the DBTDL was the cure catalyst and the IPDI was the curative.

For comparison, the ingredients were first mixed in the conventional manner by thoroughly mixing all but the IPDI/DBTDL curing agent/catalyst mix, and then mixing in the IPDI/DBTDL last. The result was a spongy mixture full of many small voids, just like a sponge.

Next, the methodology of the present invention was employed. The following mixes were made to illustrate the methodology of the present invention. No oxidizer was incorporated for purposes of illustration and to avoid any possibility of other side reactions with the oxidizer. However, one skilled in the art knows that other ingredients may be incorporated for other propellant compositions.

Step 1: All of the IPDI isocyanate/DBTDL was mixed with the metal Boron (SB-90) prior to adding the rest of the ingredients. The mixture was allowed to react for five minutes.

Step 2: The GAP polyol, GAP plasticizer, and the IPDI/DBTDL/Boron mixture from step 1 were mixed.

Once the improved non-spongy GAP propellant was fully mixed, the propellant formulation was cast according to conventional techniques, and then cured.

In this case no sponginess was observed. The volume of the cured mixture, which the isocyanate was pre-reacted with the boron, was about half that of the mix made in the conventional manner.

Although the isocyanate was isophorone diisocyanate (IPDI), one skilled in the art will readily understand that other isocyanates may be used, such as tetramethylxylenediisocyanate (TMXDI), or others as listed above. One skilled in the art will also realize that a pre-determined amount of IPDI/DBTDL may be reserved from the total amount for economy, and the reserved IPDI/DBTDL may be mixed with the metal Boron (SB-90) and reacted prior to adding the rest of the ingredients. Alternatively, a small amount of IPDI alone may be mixed with the metal Boron (SB-90) and reacted prior to adding the rest of the ingredients, and the DBTDL can be added in step 2 along with the GAP polyol and GAP plasticizer, and the IPDI/Boron mixture from step 1. Also, the pre-treatment may employ different isocyanates to neutralize the acidity of the boron, such as the less expensive toluene diisocyanate (TDI). Where a reserved amount of isocyanate or IPDI/DBTDL mixture is used in step 1, the required amount is readily determined by titrating the acidity of the boron and calculating the amount of isocyanate required to neutralize its residual acidity. Alternatively, the amount of acidity of the boron present and thus the amount of isocyanate required can be determined analytically. Additionally, conventional solvents can be added in the first step to increase the overall liquid volume in order to ensure complete reaction of the boron with the isocyanate. This process step helps reduce the amount of isocyanate required (to just a small amount or excess to ensure complete reaction) to neutralize the acidity of the boron. When excess isocyanate is reserved for this purpose, the remaining amount of the isocyanate can be added at any time during the mix process in the second step.

The foregoing technique is equally applicable to all isocyanate cured binder formulations that use metal boron fuel (for example, HTPB polymers). Once mixed by this technique, the propellant may be cast according to conventional techniques. The fully cured cast propellant will contain no internal gas bubbles. The initial neutralization of the metal fuel avoids gassing and improves the mechanical properties of the propellant yield. The present method and resulting formulation does not contain ingredients with unknown effects, and may be economically manufactured to provide for widespread, cost-effective use.

Having now fully set forth an exemplary embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

Finally, the numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed:

1. A method for making a propellant formulation comprising a solid metal particulate fuel dispersed in a cured binder matrix, from ingredients including a particulate metal fuel including boron, binder polymer, binder plasticizer, and curing agent including isocyanate, comprising:

a pre-curing step of mixing said particulate metal fuel with said isocyanate to neutralize acidity of said particulate metal fuel; and mixing said particulate metal fuel and said isocyanate from said pre-curing step with said binder polymer and said binder plasticizer to form a solid propellant.

2. The method for making a propellant formulation according to claim 1, wherein said particulate metal fuel is boron.

3. The method for making a propellant formulation according to claim 1, wherein said isocyanate is isophorone diisocyanate (IPDI).

4. The method for making a propellant formulation according to claim 1, wherein said isocyanate is toluene diisocyanate (TDI).

5. The method for making a propellant formulation according to claim 1, wherein said binder polymer is Glycidyl Azide Polymer (GAP) polyol.

6. The method for making a propellant formulation according to claim 1, wherein said binder plasticizer is Glycidyl Azide Polymer (GAP) plasticizer.

7. The method for making a propellant formulation according to claim 1, wherein said polymer is hydroxyl-terminated polybutadiene (HTPB).

8. The method for making a propellant formulation according to claim 1, wherein said curing agent additionally includes dibutyl tin dilaurate [DBTDL] added in said second step.

9. The method for making a propellant formulation according to claim 1, wherein said ingredients further comprise an oxidizer, and said oxidizer is added in said second step.

10. A method for making a propellant formulation comprising a solid metal particulate fuel dispersed in a cured binder matrix, from ingredients including a particulate metal fuel, binder polymer, binder plasticizer, and curing agent containing isocyanate, comprising:

a pre-curing step of mixing said particulate metal fuel with a predetermined amount of said isocyanate to neutralize acidity of said particulate metal fuel; and mixing the particulate metal fuel and isocyanate from said pre-curing step with said binder polymer, said binder plasticizer, and said curing agent to form a solid propellant.

11. The method for making propellant formulation according to claim 10, wherein said metal fuel is boron.

12. The method for making propellant formulation according to claim 10, wherein said isocyanate is isophorone diisocyanate (IPDI).

13. The method for making propellant formulation according to claim 10, wherein said toluene diisocyanate (TDI).

14. The method for making propellant formulation according to claim 10, wherein said binder polymer is Glycidyl Azide Polymer (GAP) polyol.

15. The method for making propellant formulation according to claim 10, wherein said binder plasticizer is Glycidyl Azide Polymer (GAP) plasticizer.

16. The method for making propellant formulation according to claim 10, wherein said polymer is hydroxyl-terminated polybutadiene (HTPB).

17. The method for making propellant formulation according to claim 10, wherein said curing agent additionally includes dibutyl tin dilaurate [DBTDL].

18. The method for making propellant formulation according to claim 17, wherein said dibutyl tin dilaurate [DBTDL] is added in said second step.

19. The method for making propellant formulation according to claim 10, wherein said ingredients further comprise an oxidizer, and wherein said oxidizer is added in said second step.

20. A method for making a propellant formulation comprising a solid metal particulate fuel dispersed in a cured binder matrix, from ingredients including a particulate metal fuel, binder polymer, binder plasticizer, and curing agent containing a pre-determined amount of isocyanate, comprising:

reserving an amount of isocyanate from said pre-determined amount;

pre-curing said particulate metal fuel with said reserved amount of isocyanate to neutralize acidity of said particulate metal fuel; and mixing the particulate metal fuel and reserved isocyanate from said pre-curing step with said binder polymer, binder plasticizer, and curing agent inclusive of remaining isocyanate, to form a solid propellant.

* * * * *